US009822588B2

(12) United States Patent
Kočiš

(10) Patent No.: US 9,822,588 B2
(45) Date of Patent: Nov. 21, 2017

(54) MULTIMODAL ROCK DISINTEGRATION BY THERMAL EFFECT AND SYSTEM FOR PERFORMING THE METHOD

(71) Applicant: GA DRILLING, A.S., Trnava (SK)

(72) Inventor: Ivan Kočiš, Bratislava (SK)

(73) Assignee: GA DRILLING, A.S. (SK)

( * ) Notice: Subject to any disclaimer, the term of this patent is extended or adjusted under 35 U.S.C. 154(b) by 189 days.

(21) Appl. No.: 14/653,233

(22) PCT Filed: Dec. 16, 2013

(86) PCT No.: PCT/SK2013/050015

§ 371 (c)(1),
(2) Date: Jun. 17, 2015

(87) PCT Pub. No.: WO2014/098776

PCT Pub. Date: Jun. 26, 2014

(65) Prior Publication Data

US 2015/0345225 A1 Dec. 3, 2015

(30) Foreign Application Priority Data

Dec. 17, 2012 (SK) ..... 50058-2012

(51) Int. Cl.
*E21B 7/14* (2006.01)
*E21B 7/15* (2006.01)
*E21B 7/18* (2006.01)

(52) U.S. Cl.
CPC ..... *E21B 7/15* (2013.01); *E21B 7/14* (2013.01); *E21B 7/18* (2013.01)

(58) Field of Classification Search
CPC ... E21B 7/14; E21B 7/146; E21B 7/15; E21B 7/18
See application file for complete search history.

(56) References Cited

U.S. PATENT DOCUMENTS 2,308,860 A 1/1943 Clark
2,822,148 A * 2/1958 Murray ..... E21B 7/15 175/100

(Continued)

FOREIGN PATENT DOCUMENTS

DE 102011053106 * 2/2011 ..... B23K 10/00
FR 727948 A 6/1932

(Continued)

OTHER PUBLICATIONS

Translation of DE102011053106A1, Espacenet, 2 pages.*

(Continued)

*Primary Examiner* — Cathleen R Hutchins
(74) *Attorney, Agent, or Firm* — Hovey Williams LLP

(57) ABSTRACT

Multimodal rock disintegration by non-contact thermal effect, spallation, melting, evaporation of a rock through a movable electric arc, arc thermal expansion and subsequent shock pressure wave allows in comparison with currently available and known technologies to drill into the rock by direct action of the electric arc and heat flows generated by the electric arc. The principle of the disintegration is based on the electric arc generation, force action to it and pressing it towards the rock intended to disintegrate, which causes heating of the rock so that a phase change and thermal disintegration of the rock occurs. Subsequently, the crushed rock is transported by a fluid streams, which are involved in stabilizing and guiding of the electric arc, from the area between the rock and the electric arc, which is the area of the rock disintegration.

25 Claims, 2 Drawing Sheets

(56) References Cited

U.S. PATENT DOCUMENTS

| | | | | |
|---|---|---|---|---|
| 2,868,950 | A | 1/1959 | Gage | |
| 2,979,449 | A | 4/1961 | Sheer et al. | |
| 3,082,314 | A | 3/1963 | Arata et al. | |
| 4,055,741 | A | 10/1977 | Bykhovsky et al. | |
| 5,244,488 | A | 9/1993 | Sato et al. | |
| 5,479,994 | A | 1/1996 | Soloviev et al. | |
| 6,744,006 | B2 | 6/2004 | Johnson et al. | |
| 7,727,460 | B2 | 6/2010 | Deegan et al. | |
| 7,784,563 | B2 * | 8/2010 | Rodland | E21B 7/15 175/16 |
| 2013/0081874 | A1 * | 4/2013 | Gutsol | E21B 7/15 175/1 |

FOREIGN PATENT DOCUMENTS

| | | | | |
|---|---|---|---|---|
| WO | WO03/069110 | * | 8/2003 | E21B 7/15 |
| WO | 2011/037546 | A2 | 3/2011 | |

OTHER PUBLICATIONS

International Search Report and Written Opinion dated Sep. 30, 2014 in corresponding PCT/SK2013/050015 (9 pages).

Munz et al., "Application of transferred arcs to the production of nanoparticles", Pure Appl. Chem., vol. 71, No. 10, pp. 1889-1897, 1999, copyright 1999 IUPAC (9 pages).

Bulgakova et al., "Pulsed laser ablation of solids: transition from normal vaporization to phase explosion", Appl. Phys. A, 2001, vol. 73, p. 199-208 (10 pages).

Woskov et al., "Annual Report 2009 Millimeter Wave Deep Drilling for Geothermal Energy, Natural Gas and Oil", Sep. 2009, Plasma Science and Fusion Center, Massachusettes Institute of Technology, Cambridge, MA 02139 (8 pages).

Augustine, "Hydrothermal Spallation Drilling and Advanced Energy Conversion Technologies for Engineered 3eothermal Systems", Jun. 2009 PhD Thesis, Massachusetts Institute of Technology (333 pages).

Gibert et al., "Effect of crystal preferred orientations on the thermal diffusivity of quartz polycrystalline aggregates at high temperature", Tectonophysics vol. 465, Issues 1-4, Feb. 20, 2009, pp. 150-163 (Abstract only, 2 pages).

Yutkin, L.A., Elektrogidravliceskij efekt. Mashinostrojenie—Leningradskoe otdelenie, Leningrad, ISBN 3806811601 (1986) (article could not be found).

Bluhm et al., "Application of Pulsed HV Discharges to Material Fragmentation and Recycling", IEEE Transactions on Dielectrics and Electrical Insulation, vol. 7, No. 5, Oct. 2000, pp. 626-636 (Abstract only, 1 page).

Dubovenko et al., "Underwater electrical discharge characteristics at high values of initial pressure and emperature", IEEE International Conference on Plasma Science 1998 (Abstract only, 1 page).

Hasebe et al., "Focusing of Shock Wave by Underwater Discharge, on Nonlinear Reflection and Focusing Effect", Zairyo (Journal of the Society of Materials Science, Japan), vol. 45, No. 10, Oct. 15, 1996, pp. 1151-1156 (6 pages).

Weise et al., "Experimental investigations on rock fractioning by replacing explosives with electrically generated pressure pulses", IEEE International Pulsed Power Conference—Digest of Technical papers vol. 1, 1993 (1st page only, 1 page).

Von Neumann et al., "A Method for the Numerical Calculation of Hydrodynamic Shocks", Journal of Appl. Physics 21, 232-237, 1950 (18 pages).

* cited by examiner

MULTIMODAL ROCK DISINTEGRATION BY THERMAL EFFECT AND SYSTEM FOR PERFORMING THE METHOD

RELATED APPLICATIONS

This application is the National Stage of International Patent Application No. PCT/SK2013/050015, filed Oct. Dec. 16, 2013, which is hereby incorporated by reference in its entirety, and which claims priority to Slovakian application No. PP50058-2012, filed Dec. 17, 2012.

TECHNICAL FIELD

The invention relates to multimodal rock disintegration by thermal effect and system for its performing and it belongs especially to a field of drilling in geological formations.

BACKGROUND ART

Heat treatment of materials by an electric arc has a long history since the mid-19th century, when this phenomenon was discovered. The devices able to generate high temperatures up to several 10,000 K were developed.

Building on these applications the transferred electric arc started to be used in the field of welding and cutting, processes where materials also undergo intense melting and a partial vaporization. All these methods use processed material as one of the electrodes. Innovations in this area have been known since the first half of the 20th century. Their common drawback is that they use the welded or cut material/metal/as one of the electrodes.

The first application was melting metal in electric arc furnaces, which represented a big change from hydrocarbon fuelled furnaces.

One of the patents using transferred arc in this field was U.S. Pat. No. 5,244,488 Ryoda et al., which for the first time did not use the melted material as one of the electrodes, but instead three electrodes between which the arc process took place. Similar principle was employed in the method described in U.S. Pat. No. 2,979,449 Carbothermic reduction of metal oxides by Sheer, C. et al. which used temperatures up to 10 000 K for vaporizing materials and their subsequent condensation and obtaining pure metal.

Similarly, the implementation method of the plasma reactor according to U.S. Pat. No. 7,727,460 used two electrodes, independent of the processed material, for carrying out the transferred arc that vaporizes the material.

In the fifties the first applications of thermal plasma generators came, in particular plasma cutting, welding and plasma coating by metallic and ceramic layers.

The U.S. Pat. No. 2,868,950 Electric Metal-Arc process and apparatus by Gage, R. M., the U.S. Pat. No. 3,082,314 Plasma arc torch by Arata, Y. et al. and U.S. Pat. No. 4,055,741 Plasma arc torch by Bykhovsky et al. describe plasma vortex generators. Their common drawback is a torch temperature limit to a maximum of about 6000 K.

Acme of the use of plasma generators for heat treatment of materials is the concept of coupled generators/twin plasma torch/, which is described in U.S. Pat. No. 6,744,006 Twin plasma torch apparatus by Johnson, T. P. et al. Its advantage is the electrical independence from processed material. The shortcomings are that its scope of action is limited to a line and the big size of the device generating the electric arc.

The closest to the issue of present patent is the material vaporization by a transferred arc in order to generate micro or nanoparticles.

The article: *Application of transferred arcs to the production of nanoparticles* by Munz, R J., Addona T., da Cruz, A. C. gives an overview on how to utilise an electric arc in order to produce nanoparticles by evaporating the parent material. In PhD thesis: *Experimental and modelling study of the plasma vapour synthesis of ultrafine AlN powders*, Mc Gill University, Montreal, 1998.

The described systems share one common feature, which is also their drawback, that is the evaporating material forms the anode consumed, one that carries one of the roots of the transferred arc.

Regarding physics of material vaporization process, the vaporization is handled by with a high-power laser beam (MW to TW) but lasting only on the order of microseconds or up to nanoseconds, exceptionally femtoseconds. These principles are not practically applicable for drilling processes, but they are a good theoretical reference source for theoretical work on the processes of vaporization, agglomeration, condensation, clustering, as well as shielding the energy flow from the transferred arc by evaporated rock.

In the article by N. M. Bulgakov and A. V. Bulgakov. *Pulsed laser ablation of solids: Transition from normal vaporization to phase explosion.—Appl. Phys. A,* 2001, Vol. 73, p. 199-208 the authors describe rapid, almost explosive vaporization of material under the effect of intense heat flow of a laser beam.

Several application papers to use the lasers for rock disintegration in drilling through geological formations were based on this analytical field of pulse material vaporization.

Using laser vaporization, however, has one major drawback. The laser beam is essentially a point source of heat. To cover the entire surface of the borehole it is necessary to blur the beam, which significantly decreases surface power density (W/m2), or to scan the beam across the surface and thereby decrease the power delivered per unit area of 2 to 3 orders of magnitude. Another drawback is the big size of high-power lasers and the need to bring from the surface through optical conduit large power capacity down to the bottom of the borehole (5-10 km), which means substantial losses or the need to use dozens of lasers in parallel.

Similarly important reference source is the use of electromagnetic millimeter waves for fusing, respectively vaporization of the rock for the purpose of drilling described in article: Annual Report 2009, *Millimeter Wave Deep Drilling For Geothermal Energy, Natural Gas and Oil MITEI Seed Fund Program*, Paul Woskov and Daniel Cohn, MIT Plasma Science and Fusion Center 167 Albany Street, NW16-110, Cambridge, Mass. 02139.

Another promising process of rock disintegration by direct action of an electric arc is the use of the spallation phenomenon, which is based on the overheating of the surface layers causing greater distension in them than in the layers lying underneath them, thus an increase in tension leading to the flaking of the surface layers. The current state of this technology is described in the paper by Ch. R. Augustine in his PhD thesis (MIT), "*Hydrothermal spallation drilling*" (2009). The current situation drawback is the use of thermal plasma as "hydrothermal flame" working in the supercritical region. This process is difficult to control with large time constants. Also not all rocks exhibit spalling phenomenon. Drilling disintegration technologies based on spallation cannot be then used and must be supplanted by conventional mechanical drilling.

Rock disintegration by thermal effect using the rock phase weakening by thermal effect and subsequent sudden cooling is the standard way of rock disintegration known for millennia.

The patent U.S. Pat. No. 5,479,994 "Method of electro-thermomechanical drilling and device for its implementation" by Soloviev G. N. et al. describes a two-phase technology based on the primary rock drying (dehydration) to a temperature of 750-950 K, the following mechanical treatment and in the third step its heating up to 1800-2 300 K. Its disadvantage is the high energy consumption.

For example, for rock containing quartz the heating is carried out preferably above 850 K. At this temperature a phase change occurs and recrystallization, which leads to the volume expansion of quartz crystals analogous to that of a water to ice phase change, leads to the formation of cracks. (Benoit Gibert, David Mainprice: *Effect of crystal preferred orientations on the thermal diffusivity of quartz polycrystalline aggregates at high temperature. Tectonophysics* 465 (2009) 150-163). Similarly to the cycles of ice freezing and ice melting, cycling around the phase transition temperature increases the efficiency of the whole process of cracking and thus also the process of weakening the rock in terms of its strength characteristics.

Another known method for increasing the disintegration process efficiency is the use of a thermal shock by intensive cooling of the heated volume of rock.

Electrohydraulic phenomenon, described by L. Yutkin in his 1955 paper ("Yutkin, L. A. (1986). *Elektrogidravliceskij efekt. Mashinostrojenie—Leningradskoe otdelenie*, Leningrad, ISBN 3806811601 forms the theoretical basis for the use of thermal explosive process that generates the pressure shock waves. Further theoretical basis are publications:

Bluhm, H. et al., "*Application of Pulsed HV Discharges to Material Fragmentation and Recycling", IEEE Transactions on Dielectrics and Electrical Insulation*, vol. 7, No. 5 Oct. 2000, 625-636;

Dubovenko, K V. et al., "*Underwater electrical discharge characteristics at high values of initial pressure and temperature*", IEEE International Conference on Plasma Science 1998 1998;

Hasebe, T et al., "*Focusing of Shock Wave by Underwater Discharge, on Nonlinear Reflection and Focusing Effect*", Zairyo (Journal of the Society of Materials Science, Japan), vol. 45. No. 10 Oct. 15, 1996, 1151-1156.

Weise, Th. H. G. G. et. al., "*Experimental investigations on rock fractioning by replacing explosives with electrically generated pressure pulses", IEEE International Pulsed Power Conference—Digest of Technical papers* vol. 1, 1993) describes the use of a thermal effect within the spark cross-section or an arc in the water, with subsequent heat explosion and further generation of pressure shock wave that fragments, or deforms the material in its vicinity.

Shock waves effects and processes were described in detail by J. von Neumann and R. D. Richtmyer "*A method for the numerical calculation of hydrodynamic shock" J. of Appl. Physisc* 21, 232-237 (1950).

One of the first patent teaching the use of electric arc for drilling in soil (rock) was the French patent no. 727948 under the name "Procede d'execution de forages" from author J. Mekel et al. The claims and description are in very general and broad form and according to the teaching of the patent they contain principal incorrect formulations which would need substantial inventive effort to be realized as it is claimed.

The particular patent's claims concern:

1) The one electrode and the rock as two poles for the arc is not realistic in real rocks because of their very low conductivity which does not allow to ignite the electric arc (the authors admit the failure in the description).
2) The two electrodes concept looks as usable and realistic, but it has substantial, for the intended function serious drawbacks which need intensive inventive activities which are not documented in this referenced patent.
   a) The electrical arc has its roots on the nearest points of two electrodes if not under influence of external forces. Patent teaches only magnetic forces pushing in the "down" direction which lets the outer parts of the electrodes in "shadow" of the arc and the rock on the outer side is not melted, is colder with the consequences that the pair of electrodes would not be able to penetrate because of hard or at least high viscosity "cold" melt.
   b) The referenced patent teaches the application of strong "violent" stream of gas to the bottom of the drilling, without mentioning any directional control of said stream or its initial direction and interaction with the melted rock and the respective violent cooling effect. The application of strong gas stream is used for flushing the bottom not for creation of continuous plasma flow.
   c) The referenced patent teaches to maintain high pressure to the bottom of the drilled wall to press the melted rock to the porous surrounding rock. This concept does not work to remove the melted rock because either the rock is not porous enough and because of cooling effect of the rock does not allow to penetrate the melt deep enough and to place even fraction of the melted rock. The higher pressure as is claimed does help to solve the problem.
3) As shown in previous the referenced patent was too broad and generally foimulated and the claims as we described are not realizable without deep and several inventive steps.

The patent by Clark Malcom, US2308860 "Means of drilling rock, concrete and like" describes a rock drill, comprising a high frequency discharge circuit including a high voltage transformer and a grid control mercury vapour discharge tube, one side of high voltage condenser being connected to ground, the other side of condenser being connected through the discharge tube; a rock drilling arc electrode connected in series with said grid control mercury vapour tube and with the grounded surface to be drilled; an insulated spacer placed between the end of rock drilling arc electrode and the surface to be drilled and power and timing means whereby high voltage condenser may be charged and discharged through mercury vapour tube, thereby producing an arc between said rock drilling electrode and the surface to be drilled.

The solution has following drawbacks:

1) The substance of the concept is the short electrical discharge (spark) and not continuous electrical arc as in our patent
2) The short intensive process is based on intensive heating of water present in the material to the high temperature which causes violent expansion of the water steam in the material and explosive destruction of material and not thermal transformation above the discharge channel.
3) The explosive process produces cuttings of different sizes. The sizes of cutting are not under control.

The further work on this concept was performed at University of Omsk, University of Strathclyde, Dresden University. The discharge of high voltage (150-200KV) was experimentally used at University of Trondheim as electrical discharge assisted to classical mechanical drilling.

The patent WO 2011/037546 by authors Kocis Ivan at al.: "Method of disintegrating materials and device for performing the method" discloses the disintegration of material by high energy water jet and not heat. The high energy water jet is produced by expansion of water by high energy electrical discharge in a pressure chamber filled with water.

The paper Low-Temperature Sintering of Indium Tin Oxide Thin Film Using Split Gliding Arc Plasma from Yukikazu Ito at al., published in Japanese Journal of Applied Physics, Vol. 47, No. 8, 2008, pp. 6956-6959, describes the classical plasma torch configuration where the internal electrical arc between two electrodes in comparison with the proposed spiral gliding arc which allows to heat larger cross section of linearly flowing gas (without nozzle) and then the heated gas is flowing intensively to the surface material. The arc is not near to the material and only flowing heated mediator gas is in the contact with the processed material.

SUMMARY OF THE INVENTION

Above-described processes have not yet been performed by directly applying electric arc on the surface of the rock. The present invention eliminates shortcomings and drawbacks to these processes and forms a base for employing electric arcs for the purposes of drilling into geological formations.

Multimodal rock disintegration by thermal effect method is based on an electric arc acting directly on the rock with at least part of the electric arc being actively pressed by forces upon the surface of the rock being disintegrated. The electric arc is produced in an electric arc generator whose construction is not the object of this invention. Similarly the method of electric arc production in an electric arc generator is also not the object of this invention. The electric arc generator creates an electric arc and directs it into the area where it can be further shaped and moved around near the rock by action force modules. By direct exposure to the electric arc, the rock is intensively heated, which causes its disintegration. The crushed rock is subsequently transported away from area between the rock and the electric arc.

Direct action of the electric arc on the rock means that there is no intervening medium to facilitate heat transfer between the arc and the rock. In the conventional plasmatrons the electric arc energy is transmitted through a medium and the medium alone acts on the rock. This invention solves this problem by taking and shaping the electric arc which then directly acts on the rock being disintegrated. Precisely in order to achieve this, it is necessary during the whole process to shape and push the arc against the rock and remove all crushed material and all excess gases from area between the rock and the arc so as to allow direct contact between the electric arc and the rock surface.

The rock is being intensively heated and by this heating the spallation temperature can be reached, the overheating making the spallation occur. When heated above the melting point, we get molten rock which is then removed from the borehole in this state. In other modes the rock can be heated above the boiling point which leads to its intense evaporation.

A section of the electric arc's conductive channel is by its shaping positioned close above the surface of the rock being disintegrated. This part of the conductive channel can be in a static or moving state. It is preferred that at least portion of the transferred electric arc is shaped such that the conductive channel of the electric arc has a shape of a spiral, which rotates in a specified discoid area. This spiral shape of the conductive channel is formed by the action of magnetic and/or the fluid stream forces.

Another magnetic and/or fluid stream force action presses the shaped electric arc against the surface of the rock being disintegrated.

The forces of the first fluid stream act on the electric arc simultaneously by a tangential component and an axial pressure component. The axial component presses the electric arc to the rock and the tangential component is pushing it towards the outer perimeter of the rock surface being disintegrated.

Also the forces induced by the magnetic field act on the electric arc simultaneously by their tangential component and the axial pressure component.

Crushed rock needs to be transported away from the area between the rock and the electric arc. A second supplied fluid stream does this when it enters between the rock and the electric arc and carries the crushed rock away from the area between the rock and the electric arc.

It is preferred that the first fluid stream functions also as the second fluid stream that is it removes the crushed rock. In that case the first fluid stream is directed to pass through the arc and come close to the rock and at the same time functions as the first fluid stream, wherein with its axial and tangential components shapes and presses the electric arc. When subsequently impacting the rock being disintegrated it is deflected radially outwards the arc electric area. The first fluid stream then has also a transport function, i.e. it removes and carries away the crushed rock from area between the electric arc and the rock. The process of transporting the excess material can be achieved also by mechanical raising of crushed rock by generating a pressure wave by electro-hydraulic effect. This phenomenon and/or the action of fluid streams can serve as alternative methods for removing crushed rock.

It is preferred that the radiation component of the arc's heat flow that is heading away from the rock is redirected by reflecting surface towards the rock being disintegrated. In this way higher portion of the heat flow can be exploited and the efficiency of the process increases.

The first fluid stream, together with the supplied second fluid stream and the evaporating rock, have stabilizing influence on the electric arc. This keeps the moving electric arc in a well-defined area and close to the rock being disintegrated.

It is preferred in terms of interaction force between the fluid streams and the electric arc distribution for the supplied second fluid stream to incidents perpendicularly on the surface of the rock in the centre of the area where the electric arc acts and to diverge radially from the centre towards the edges of the transferred arc. The second fluid stream entering the centre of the area where the electric arc acts on the rock at normal incidence is uniformly redirected to the edges of the disintegration hole, by which constant and uniform volume flow in raising the crushed rock is achieved.

The electric arc can move within an area with the shape of a cylindrical wall and then it acts on the rock in the area being shaped as a circular ring.

The first fluid stream and/or the second fluid stream can incident on the electric arc from the inner perimeter of the area shaped as cylindrical wall in which the electric arc operates and/or from the outer perimeter of the area shaped as cylindrical wall in which the electric arc operates.

It is preferred that the reflecting surface that redirects the radiation component of the arc's heat flow away from the rock is the electric arc generator's electrode.

The pressing forces can partially embed the electric arc into the rock.

Rock disintegration by thermal effect is achieved because the heat flow from the electric arc gradually increases the temperature of the rock and the rock is gradually weakened by dehydration, recrystallization, different expansions of the various types of crystals and the likes.

The rock being disintegrated can be alternately heated by the electric arc's heat flow and cooled by the second fluid stream and thus stressed, which causes its weakening.

If the electric arc current is increased, the arc expands, is pushed towards the rock, and at the same time pushing the crushed rock away from the area between the electric arc and the rock.

A jump increase in electric arc's current generates a shock wave that intensifies mechanical disintegration in the rock and pushes the crushed rock away from the area of rock disintegration.

If the pulse increase in the electric arc current melts the rock, the arc itself expands and is pushed against the rock while simultaneously pushing the melted material away from the area between the electric arc and the rock. The second supplied stream enters between the rock and the electric arc and enhances the effect of the pressure shock wave and its action on the rock being disintegrated.

According to the particular geological conditions and the type of rock being disintegrated different operating modes of rock disintegration appropriate for a given environment are possible, thereby minimising energy demand, costs of drilling, respectively maximising penetration speed. Rocks with different properties react differently to heat disintegration; therefore it is necessary to use appropriate operational modes, technological methods which are adaptable to rock types present in the borehole, i.e. multimodal rock disintegration.

Depending on the rock disintegration method the disintegration can run in the following operating modes, which run separately or in combination:

1. Disintegration Using the Combination of Heat Effects and Pressure Shock Waves The device works using electric arc generator shown in FIG. 1. The rock is first exposed to the heat flow generated by an electric arc, which can reach temperatures of up to several 10 thousand Kelvin. The most significant properties include mechanical strength and flexibility, which are lowered by the action of the heat flow. The heat flow causes intense and rapid heating of the rock and at the specific temperature causes change in its mechanical properties. This change is caused by various physico-chemical reactions, for example recrystallization, dehydration and the like. Consequently the pressure shock wave, which is caused by electro-hydraulic effect, induces fragmentation. The recrystallization intensifies the resultant effect of disintegration by its electro-hydraulic effect on the rock. The rock fragments removal is provided by a further pressure pulse and/or fluid flow of another supplied medium. The advantage of this mode is achieving higher drilling speeds and efficient use of thermal energy, which is supplied largely only into the rock which is to be immediately removed and thus multiple heatings and subsequent coolings do not occur.

The energy required to disintegrate the rock is about 200-1000 J/cm3

2. Rock Disintegration Using Spallation (Temperature~940-960 K)

The device works using electric arc generator shown in FIG. 1. The rock is exposed to the heat flow generated by an electric arc. At the critical temperature spallation occurs in some rocks. Because of differing dilation and mechanical stresses between the top layer and the layers below, a spontaneous spallation of small sections occurs at different rock temperature intervals. Resulting rock fragments are removed by the pressure shock wave generated by an electro-hydraulic effect and/or a fluid flow of supplied medium. Specific rock types have intervals where the spalling process is markedly effective and its drilling speed can exceed speeds of mechanical drilling. In addition, the rock is naturally fragmented into particles small enough to be easily transported and requires no further treatment to adjust their size.

The energy required to disintegrate the rock is about 2 000-3000 J/cm3

3. Rock Disintegration by Melting (Temperature>1 800 K)

The device works using electric arc generator shown in FIG. 1. The rock is exposed to the heat flow generated by an electric arc and heated above its melting point. The melted rock is then removed by pressure shock wave generated by an electro-hydraulic effect and/or fluid streams of another supplied medium. In this mode temperatures necessary for phase transitions are above the melting point. A portion of melted rock material can be used in casing formation.

The energy required to disintegrate the rock (granite) is about 5 000 J/cm3

4. Rock Removal by Evaporation (Granite, Temperature>3 000 K)

The device works using electric arc generator shown in FIG. 1. The rock is exposed to the heat flow generated by an electric arc and heated above its boiling point with intense rock evaporation. The rock vapours are transported away from the device working area by the pressure shock wave generated by an electro-hydraulic effect and/or fluid stream of another supplied medium. The rock in this process is in gas state of matter, which facilitates its transport away from the device working area. The excess energy of rock vapours is used in casing formation.

The energy required to disintegrate the rock (granite) is about 25 000 J/cm3

The system for rock disintegration using the thermal effect realized by direct action of an electric arc with subsequent rock disintegration contains the following technological parts:

- an arc shaping module,
- action force modules,
- a module for heat flow action on the rock and its disintegration,
- a module for crushed rock guidance and raising.

Action force modules may be as follows:

a) fluid stream force action modules and/or b) magnetic force modules, and at least one of the force action modules exerts force on the electric arc.

The module for crushed rock guidance and raising is a delimitation channel that carries away a mixture of crushed rock and media inputted into the device at the rock disintegration spots.

The module for fluid stream forces action on the arc contains a series of nozzles.

The module for magnetic forces action on the electric arc contains a system of magnetic field generators.

The module for guidance and raising of crushed rock is the interaction zone of the electric arc with the rock.

The module for reflecting surfaces directing the heat flow consists of reflecting and guidance surfaces, which are arranged in such a way that the incoming heat flows are reflected from them and are directed at the rock being disintegrated.

Depending on the particular geological conditions, the type of rock being disintegrated, the device may enter into suitable operation mode and minimize its energy demand, the costs of drilling, respectively maximise the speed of penetration. Rocks with different properties react differently to heat level of disintegration, therefore appropriate technological methods, operational modes need to be used, i.e., multimodal rock disintegration.

Depending on the rock disintegration method, the device can operate in the following operating modes running separately or in combination:

1. Disintegration using combination of heat and pressure shock waves;
2. Disintegration using spallation effect (T-940-960 K);
3. Disintegration through rock melting (T>1 800 K);
4. Rock removal by evaporation (granite T>3 000 K).

The advantages and the primary and radical innovations of the present invention are the following:

1. An electric arc with temperatures of several thousand degrees Kelvin acts thermally directly on the rock, particularly through its radiation component without the need for another intervening medium (plasma torch), which would reduce the efficiency of heat transfer to the rock;
2. Relatively homogeneous plane temperature field is present in the entire area where the process of disintegration occurs;
3. Compared to conventional plasmatron devices, the present invention allows to use the electro-hydraulic phenomenon, to generate shock and pressure waves and to use mechanical forces used to disintegrate and transport the crushed rock away from area between the arc and the rock;
4. The system allows in a pressure wave generation mode to use generation of power current pulses with charging/discharging time transformation of 4-7 orders of magnitude (sec/μsec) and thereby permits increasing the instantaneous pulse disintegration power to MW, respectively even GW;
5. The system allows to obtain electrical and/or optical parameters of the electric arc in interaction with the rock to indirectly deduce sensory information (e.g. the device distance from the bottom of the borehole, online spectroscopy, etc.).

Applications and tied innovations:

Multimodal system of thermal disintegration allows changing its mode in different geological situations and thus adapt to the changing circumstances and different types of rocks;

The system allows to optimize the drilling speed according to the type of rock, by selecting individual modes or their combinations;

The system allows to use a combination of thermal action and mechanical forces to minimize energy levels and increase the drilling speed;

The system allows to use shock waves to transport rock away from the disintegration area without cooling (for example for molten rock), which eliminates the rock removing by water jet (hydromagmatic phenomenon) which causes cooling and slows down the drilling process;

Transferring most of the electric arc outside the generator space substantially reduces demands on the thermal resistance of the used construction materials and the generator space remains cooler, which increases equipment life.

The present invention compared to the current state of the art technologies possesses following advantages: The present technology allows rock disintegration by direct action of an electric arc on the rock through non-contact thermal effect without using an intermediary heated plasma, which results in a higher efficiency of the generated heat flow into the rock. Its multimodal concept allows it to use a combination of efficient and low energy intensive thermal processes in disintegration of different types of rocks in different geological situations. It eliminates special one-purpose procedures of conventional technologies, reducing the time and thereby economic costs for rock disintegration in deep boreholes.

The combination of thermal action on the rock, electro-hydraulic phenomenon and generating the pressure shock waves utilises resulting mechanical forces to disintegrate and transport the crushed rock and thus also minimizes energy requirements and increases the drilling speed.

Transferring most of the electric arc outside the generator space substantially reduces demands on the thermal resistance of the used construction materials and the generator space remains cooler, which increases equipment life.

BRIEF DESCRIPTION OF DRAWINGS

Figures show a schema of multimodal rock disintegration system by thermal effect.

EXAMPLES OF CARRYING OUT THE INVENTION

Example 1

Figure 1:
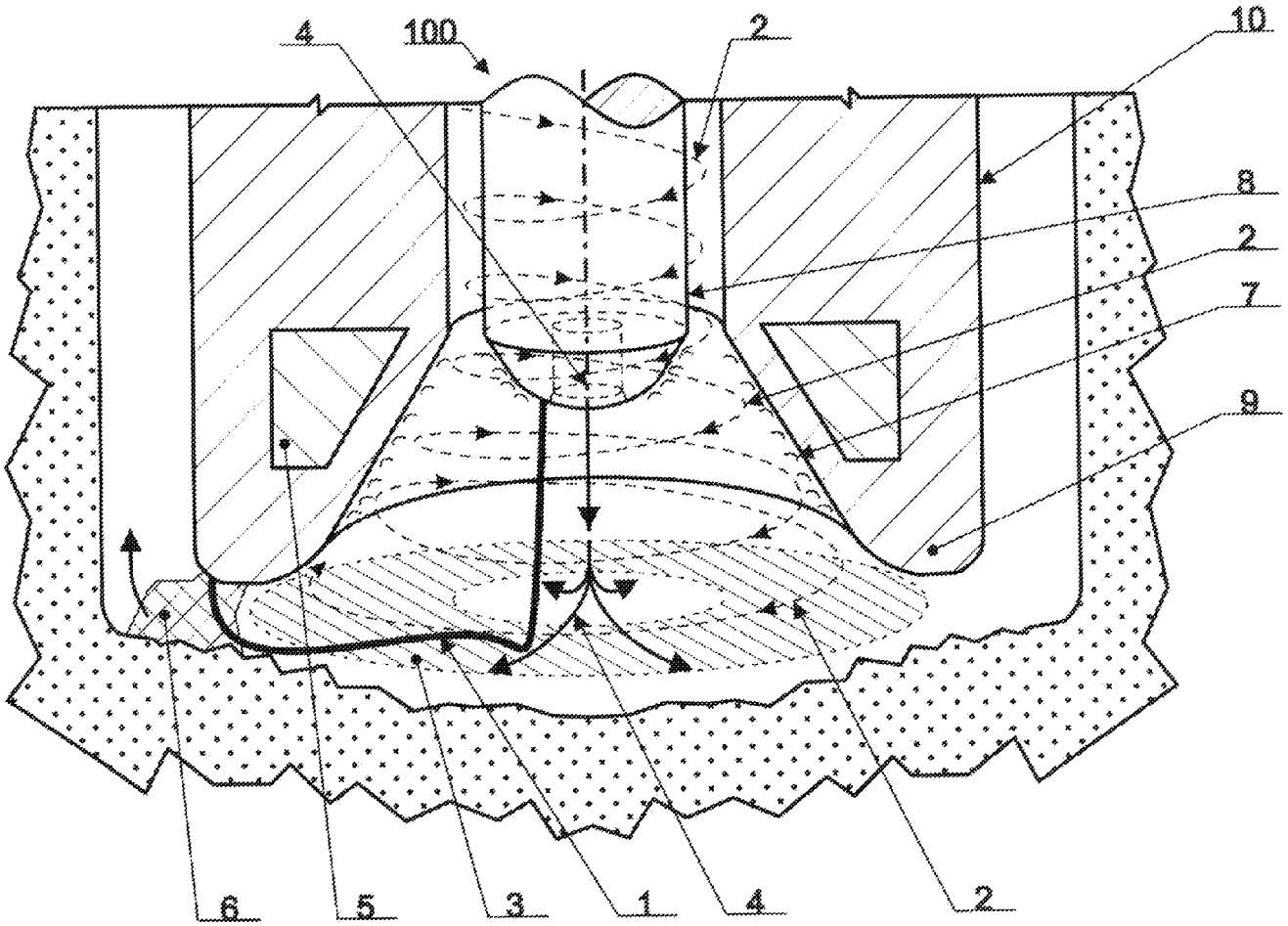
In FIG. 1 is shown a schematic layout of the part of the arc extending radially beyond the contours of the device.
Figure 2:
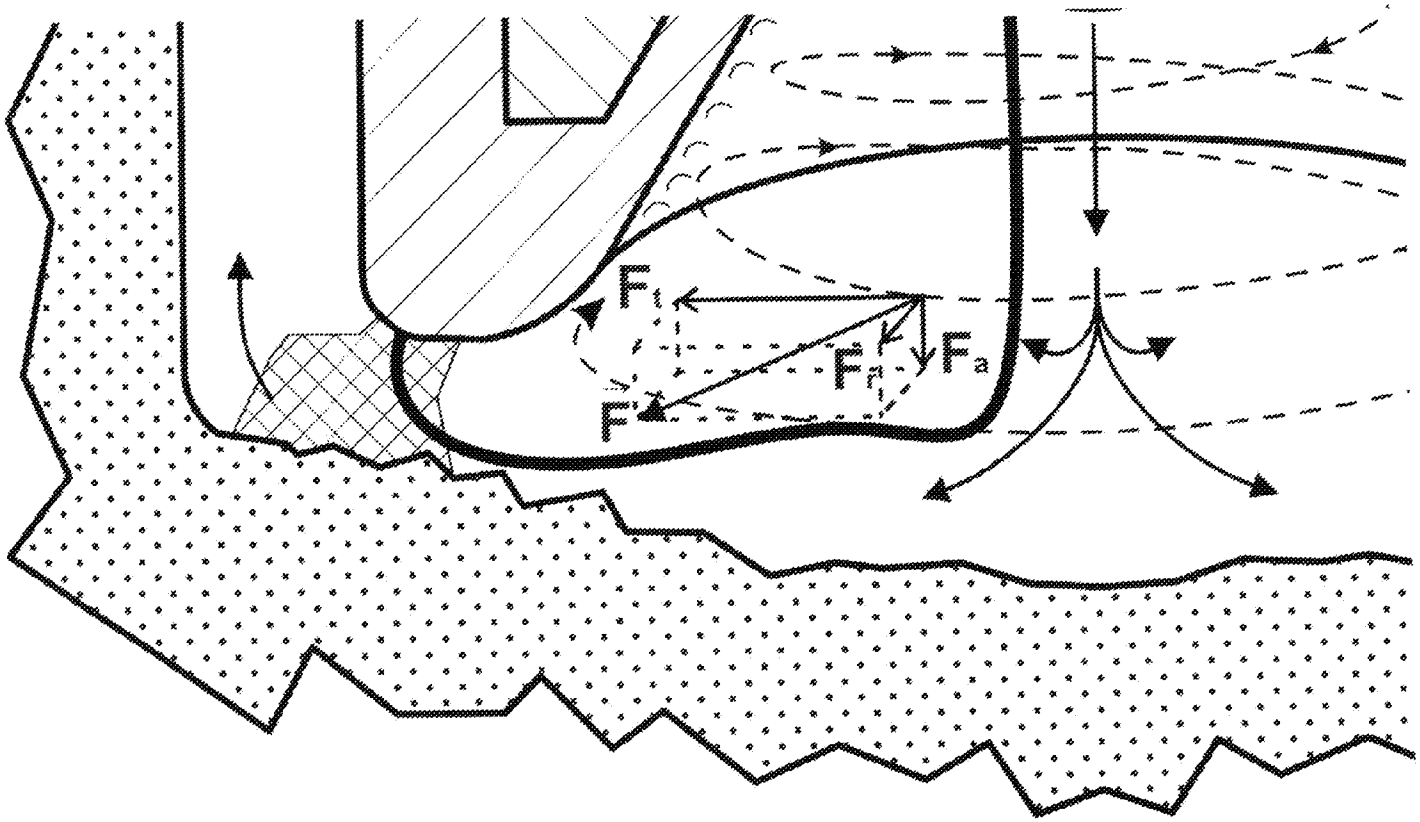
In FIG. 2 is shown an enlarged view of forces acting on the electric arc.

The object of the invention is a technological process of non-contact rock disintegration and the system for carrying out the rock disintegration process by direct thermal action on the rock and its subsequent disintegration, melting and partial evaporation. The principle of here described preferable embodiment of the invention lies in that the rock being disintegrated is heated by planar shaped and spatially directional electric arc, forming thus a high-temperature torch, rotating along the whole perimeter, having a discoid shape with dimensions larger than the contour 10 of the device, which is pressed by force action modules against the rock being disintegrated. Forces generated in device, induced by a fluid stream shaped into vortex and by an action of a magnetic field, create a force action onto the electric art and thereby, they are, by both tangential-radial component and axially pressure component, involved in its pressing against the rock, its interaction with the rock, and provide transporting and raising of the crushed rock from the disintegration area. Since the moving electric arc has a spiral shape, its force and kinematic effect in the tangential direction is expressed, from the physical and geometric nature, by tangential-radial movement. Substantially coaxial-circular arrangement of the electrodes and the force action of the fluid flow and the magnetic field allows to generate a vortex flow of plasma at the outlet of the plasma generator device.

The system implementing disintegration technological process contains the following main parts:

- electric arc generator;
- arc shaping module 100, which includes fluid and magnetic guiding and shaping components—electrodes 8, 9, discharge nozzles, magnets that actuate forces on the electric arc 1 and its shaping/formation;
- module for force action and pressing an electric arc against the rock and its control: discharge nozzles, magnets, regulation of system of flow and changes in the hydraulic circuit;
- heat flow action zone 3 of electric arc pressing against the rock and the thermal interaction with the rock;
- module 6 for guidance and raising of crushed rock.

The device also contains other parts that complement the technology, control and intensify the process of disintegration during drilling and rock disintegration by thermal effect:

- control modules for controlling and modulation of modes of fluid and magnetic guidance elements;
- module 7 of reflecting surfaces guiding heat flow to the disintegration zone;
- flushing zone raising and removing crushed rock from the disintegration zone.

Arc shaping module 1: an electric arc picked from an electric arc generator is further shaped, formed and guided in arc shaping module 1. Arc shaping module 1 is a chamber shape of which defines the area in which the formed arc channel is in its initiation position. It contains a series of nozzles to generate fluid streams and a magnetic generator. The action of magnetic forces and fluid flow forces subsequently shape the electric arc. Furthermore through the forces exerted on the electric arc the discharge moves and its movement delimits a discoid shape, larger than the cross-section of the device in the active region.

The force action modules consist of magnets generating magnetic fields 5 and the system of nozzles which by generating fluid streams 2, 4 exert force on the electric arc during its formation and when pressing against the rock. The first and the second fluid streams by their action generate forces which in the case of first fluid stream press the electric arc and in the case of second stream carry away crushed rock.

Zone 3 of heat flow action—the device working in several disintegration operating modes: The zone 3 of heat flow action is located in the lower part of the chamber just above the surface of the rock being disintegrated and it is an area of direct interactive action on the rock, i.e. a contact of the electric arc and a arc of bypassing high-temperature and dissociated gases of fluid streams. The fluid streams have dual function, namely pressing, shaping, forming by their force effect and as a plasma generating medium they are involved in the generation of plasma itself passing in the proximity of the electric arc, and thereby they create a rotating discoid plasma cloud with the contour larger than the contour of the device. During non-contact direct action of the electric arc, thermal rock disintegration leads to the disintegration of the rock. By that are generated hot gaseous mixture composed of vapours of evaporated rock and plasma generating fluid stream carrying gases, which exert forces on the electric arc. The electric arc and the flowing fluid streams with their effects, temperature ranges and thermal heating allow for multimodal operation, i.e. multiple mechanisms for rock disintegration, and thus they disintegrate the rock.

The heat levels in non-contact thermal disintegration close to the rock are controlled by control modules, a control of the electric current that is supplied to the electric arc and control of corresponding force action of force carriers on the electric arc.

Control modules: Various methods of rock disintegration, as well as different heat levels and temperature ranges can answer to different behaviour and properties of different rock types during their disintegration and their responses to the thermal effect. The control module changes the temperature of another supplied fluid stream in intervals as to intensify through alternate heating and cooling of rock being disintegrated at disintegration process that occurs through spallation, melting and evaporation of the rock material.

A sequence of signals for generating pulse rises in the electric current feeding the electric arc is formed in control module which causes the arc's expansion. The power of the electric are increases in repeated intervals in pulses, which causes the arc to expand and by the dynamic action of the flowing medium puts pressure on the rock and at the same time pushes the melted rock away from the area between the electric arc and the rock.

Reflecting surfaces module 7: The pressing electric arc itself is characterized in that the thermal energy emitted from it radiates evenly in all directions into its surroundings. That is why the heat energy radiating and routing from the rock disintegration area is reflected in heat flow reflecting surfaces module 7 and concentrated onto the surface of the rock being disintegrated. The heat flow reflecting surfaces module 7 consists of reflecting and guiding elements, which are located on the surface of the electrodes which not only guide the radiative components of the heat flow but also protect the active and exposed wall areas of the device from the heat generated by the heat flows.

Module 6 for guidance and raising of crushed rock is a zone of interaction between the electric arc and the rock and is located in the area between them. Through the flushing function of the second fluid stream 4 it is directed so as to generate a steady stream on the rock surface removing evaporating rock immediately after its forming and preventing the crushed rock from shielding and from restricting the spread of the heat flow radiation components, thereby avoiding further unnecessary heating of vapourized rock near or in the area of the electric arc. The tangential and axial pressure force components act simultaneously on the electric arc, while removing and flushing out the crushed rock material in the form of vapour, melted rock, as well as disintegrated solid phase from the bottom of the borehole.

The flowing mixture of crushed rock and the pressure and plasma generating fluid streams are raised to the edge of the rock being disintegrated while pushing before them vapourized rock fractions.

The mixture of crushed rock, flowing gases and vapours is a mixture of expanding gases and evaporated rock mixed with drift parts of rock raised radially to the edge of the device outside the rock disintegration area, where it is under pressure gradient flushed out of the device.

Example 2

Another example embodiment is a system of rock disintegration by rock melting, which operates in the same configuration, on the same principle as described in example 1, but under different temperature and power levels, preferably from 700-1800 K and the power between 3000-8000 J/cm$^3$ on the rock being disintegrated, that is in a different operating mode. They differ in the intensity of thermal action of the electric arc on the rock in the heat flow action zone 3.

During the non-contact thermal disintegration by an electric arc the rock material in a close vicinity of the rock is disintegrated by melting, which generates hot mixtures of molten rock and plasma generating, carrying fluid streams that exert force on the electric arc. In the middle range of disintegration temperatures using rock melting the interaction produces molten rock, which is carried out through the force action of another supplied fluid stream as well as expanding plasma generating medium, and which then due to mixing and cooling solidifies into fine fractions outside the zone 3 of heat flow action of the electric arc pressed on the rock.

Example 3

Another example embodiment is a system of rock disintegration through spallation effect, which operates on the same principle as described in example 1, but under different temperature and power levels, preferably from 500-1200K and the power between 1000-3000 J/cm$^3$ on the disintegrated rock, that is in a different operating mode. They differ in the intensity of thermal action of the electric arc on the rock in the heat flow action zone 3.

During non-contact thermal disintegration by an electric arc the rock material in a close vicinity of the rock is disintegrated by spallation. This fragmented material, together with carrying and plasma generating fluid streams that exerts force on the electric arc, forms a hot mixture. At lower temperatures of disintegration by spallation effect the heat flow from the electric arc disintegrates the rock by flaking off solid particles due to different thermal expansion rates of different overheated and weakened sections of the rock.

Example 4

Another example embodiment is a system combining thermal processes and pressure shock waves which operates in the same configuration, on the same principle as described in example 1, but operates under different temperature and power levels, that is in a different operating mode. They differ in the intensity of the thermal action of the electric arc on the rock in the zone 3 of heat flow action.

During non-contact thermal disintegration by an electric arc near the rock, it is first exposed to the heat flow generated by the electric arc which can reach temperatures of up to several 10,000 Kelvin. The most important properties of disintegrated rock include mechanical strength and flexibility, reduced by the action of the heat flow. The heat flow causes intense and rapid heating of the rock. At certain temperature level, the rock's mechanical properties significantly change. This change is caused by different physical-chemical processes such as recrystallization, dehydration and the like. Subsequently they are fragmented by the action of generated pressure wave. Recrystallization deepens the resulting effect of rock disintegration by the action of generated pressure wave on the rock. Removal of fragments is provided by further pressure pulse and/or fluid flow of another supplied medium. The advantage of this mode is raising the drilling speed and the efficient use of thermal energy, which is supplied largely only into the rock, which is to be immediately removed and therefore no multiple heating and subsequent cooling occurs.

Example 5

The electric arc is created by an electric arc generator and by the forces of the fluid stream and by the forces of generator's magnetic field shaped and formed into a rotational configuration. At its bottom at least part of the electric arc is, by the action of a force, pressed against the rock surface intended for disintegration. In doing so the forces induced by the first fluid stream 2 and by the magnetic field act on the electric arc simultaneously by a tangential radial component and an axial pressing component.

The action of the heat flow generated by the electric arc causes direct and intense heating of the rock and thereby its disintegration. Disintegration occurs by heating the rock to a temperature level and exceeding the boiling point, with its intense vaporization. After disintegration this rock is transported outside from the area between the rock and the electric arc.

The electric arc is located and moves just above the surface of the rock, wherein at least a portion is embedded into it. In this example embodiment at least part of the transferred electric arc is shaped as a spiral which rotates in a specified cylindrically shaped space and hence the rock surface on which the electric arc directly acts is shaped as a part of a spiral defined surface space, wherein the exposed and disintegrated area is larger than the projection or the contour of the device.

Evaporated rock is forced out by force action of the second fluid stream that expands following the pressure gradient and pushes the crushed and evaporated rock towards the borehole periphery thereby making space for further interaction of the rotating electric arc and heat transfer into the rock by radiation.

The arc's heat flow radiation component directed away from the rock is reflected in order to intensify the heat transfer into the rock being disintegrated from the reflecting surface.

The first fluid stream 2 together with the second supplied fluid stream and the vaporizing rock stabilize the electric arc. The second fluid stream 4 impacts the rock perpendicularly and diverges radially from the centre towards the edges of the transferred arc.

All fluid flows together with evaporated crushed material are flowing and carried out from area between the disintegrating rock and the electric arc.

Example 6

In this concrete embodiment example of the invention, the rock disintegration is based on heating the rock above its melting point.

The processes taking place in the initialization phase are identical to the processes described in example 5.

At least part of the arc acts directly on the rock through a heat flow. This leads to an intense heating of the rock until it melts. After melting the rock, the melt itself is transported outside from area between the rock and the electric arc.

The conductive channel of the electric arc is located and moves in close proximity to the surface of the rock being disintegrated. In this example embodiment at least part of the transferred electric arc has a conductive channel shaped as a spiral which rotates in a specified cylindrically shaped area. Hence the rock surface on which the electric arc directly acts is shaped as a part of a surface defined by spiral.

Example 7

In this concrete embodiment example of the invention, the system of rock disintegration is based on heating the rock up to the temperature of rock spallation.

The processes taking place in the initialization phase are identical to the process described in example 3, but the rock is subjected to different temperatures and power levels, that is in a different operating mode. The electric arc acts on the rock to supply enough heat in certain minimum time which is specific to each rock. Receiving more heat results in reaching a certain limit temperature and required temperature gradient in the rock. As a result of increased temperature and increased temperature gradient, the rock material fragments by spallation which generates hot mixtures consisting of fractured rock flakes and plasma generating, carrier gases of fluid streams operating by force on the electric arc. Using disintegration by spallation effect, at lower temperatures the heat flow from the electric arc disintegrates the rock by flaking off solid particles due to thermal expansion of the heated part of the rock and by weakening caused by recrystallization and different expansion rates of various types of crystals.

Example 8

In this concrete embodiment example, the rock disintegration system is based on a combination of heat processes and pressure shock waves due to rock heating.

The processes taking place in the initial phase are the same as in example 5. But unlike processes in example 5, the rock is subjected to different temperature and power levels, that is in a different operating mode. The electric arc acts on the rock so as to add sufficient heat to the rock and thereby to increase its temperature to a level at which some types of rock change its mechanical properties. The most important properties include mechanical strength and flexibility, which are reduced by the action of the heat flow. The heat flow causes intense and rapid heating of the rock which at certain temperature alters its mechanical properties. This change is caused by different physicochemical processes such as recrystallization, dehydration and the like. These processes are intensified by alternating the heat flow from the electric arc, which heats the rock, and the second fluid stream, which cools it down. The alternate heating and cooling thermally stresses the disintegrating rock.

Subsequently, the generated pressure wave fragments it. Recrystallization and other processes that weaken the rock deepen the resulting effect of disintegration by generated pressure waves acting on the rock. The rock fragments are then removed from area between the non-crushed rock and the electric arc. Thus the entire procedure can be repeated on the next layer of the non-crushed rock. The advantages of this mode are raising the drilling speed and an efficient use of thermal energy, which is supplied largely only into the rock, which will be removed immediately, and so there is no multiple heating and subsequent cooling.

The multimodality of rock disintegration consists in the fact that, depending on the disintegration method, the disintegration can take place in operating modes which run separately or in a combination according to the properties of a rock being disintegrated.

Example 9

In this concrete embodiment example, the electric arc is generated by an electric arc generator, is formed between concentric cylindrical electrodes, and is then shaped and formed in an area with the shape of a cylindrical wall by the action of the fluid stream and the action of the generator's magnetic field. In the bottom part of the system for rock disintegration by direct thermal effect, the electric arc is pressed against the rock surface to be disintegrated. The forces acting on the arc move the arc simultaneously in the axial and tangential directions. The electric arc is located and moves in close proximity to the surface of the rock being disintegrated. In this example embodiment, at least part of the transferred electric arc is shaped as a spiral which rotates in a specified space with a shape of cylindrical wall and hence the rock surface on which the electric arc directly acts takes a shape of a part of the space defined by arc's movement.

By the action of the heat flow generated by the electric arc a direct and intense heating of the rock occurs leading to its disintegration. Disintegration occurs by heating the rock to the temperature level and exceeding the boiling point causing an intense vaporization. The arc's heat flow radiation component directed away from the rock is reflected in order to intensify the heat transfer into the rock being disintegrated from the reflecting surfaces. After disintegration this rock is transported outside from the area situated between the surface of the rock being disintegrated and the electric arc by radial fluid flows. All fluid flows together with evaporated fragmented materials are flowing and carried out alongside the device.

REFERENCE SIGNS

100. Arc shaping module
1. Electric arc inside the active surface zone
2. Fluid stream force action module—first fluid stream
3. Zone of heat flow action
4. Fluid stream force action module—second fluid stream
5. Magnet force action module
6. Module for guidance and raising of crushed rock
7. Module of reflecting surfaces guiding the heat flows
8. Electric arc generator electrode
9. Electric arc generator electrode
10. Device contours

The invention claimed is:

1. Multimodal rock disintegration by thermal effect of an electric arc produced in an electric arc generator characterized in that the electric arc acts directly on the rock, wherein at least a part of the electric arc is pressed against the rock surface via forces caused by fluid streams, each force acting on the electric arc concurrently by a tangential component, a radial component, and an axial component due to the fluid streams being directed towards the rock being disintegrated so as to generate a vortex stream of plasma such that a part of the electric arc is spiral shaped and caused to rotate in a specified discoid area in close proximity above the surface of the rock being disintegrated so that the rock disintegrates via heat generated by the electric arc and is subsequently transported away from an area where the rock is disintegrated.

2. The multimodal rock disintegration by thermal effect according to claim 1 characterized in that at least part of the electric arc, after leaving the electric arc generator, is further shaped, moved around, and pressed onto the rock via magnetic forces, each magnetic force acting on the electric arc concurrently by a tangential component, a radial component, and an axial component.

3. The multimodal rock disintegration by thermal effect according to claim 1 characterized in that the rock is intensively heated to a temperature at which a physical process weakens the rock.

4. The multimodal rock disintegration by thermal effect according to claim 1 characterized in that the rock is intensively heated to a spallation temperature.

5. The multimodal rock disintegration by thermal effect according to claim 1 characterized in that the rock is intensively heated above a melting point of the rock.

6. The multimodal rock disintegration by thermal effect according to claim 1 characterized in that the rock is intensively heated above a boiling point of the rock such that the rock evaporates.

7. The multimodal rock disintegration by thermal effect according to claim 1 characterized in that one of the fluid streams is directed towards the rock near an axis of the vortex stream and, after impacting the rock, flows substantially radially between the disintegrated rock and the electric arc and carries the disintegrated rock away from an area between the disintegrated rock and the electric arc.

8. The multimodal rock disintegration by thermal effect according to claim 1 characterized in that a radiation component of heat flow of the arc that is heading away from the rock is redirected from a reflecting surface towards the rock being disintegrated.

9. The multimodal rock disintegration by thermal effect according to claim 1 characterized in that a first one of the fluid streams together with a second one of the fluid streams and the disintegrating rock have a stabilizing effect on the electric arc.

10. The multimodal rock disintegration by thermal effect according to claim 1 characterized in that one of the fluid streams incidents perpendicularly on the surface of the rock in a centre of an area where the electric arc acts on the rock and diverges radially from the centre towards edges of the electric arc.

11. The multimodal rock disintegration by thermal effect according to claim 1 characterized in that the electric arc acts on the rock in an area having a circular ring shape.

12. The multimodal rock disintegration by thermal effect according to claim 1 characterized in that the electric arc operates in an area having a cylindrical wall shape including an inner perimeter having a side, one of the fluid streams incidents on the electric arc from the side of the inner perimeter of the area in which the electric arc operates.

13. The multimodal rock disintegration by thermal effect according to claim 1 characterized in that the electric arc operates in an area having a cylindrical wall shape including an outer perimeter having a side, one of the fluid streams incidents on the electric arc from the side of the outer perimeter of the area in which the electric arc operates.

14. The multimodal rock disintegration by thermal effect according to claim 1 characterized in that at least one of the fluid streams presses the electric arc against the rock surface and removes the disintegrated rock from an area between the electric arc and the rock.

15. The multimodal rock disintegration by thermal effect according to claim 1 characterized in that the electric arc is embedded into the rock by pressure.

16. The multimodal rock disintegration by thermal effect according to claim 1 characterized in that the rock being disintegrated is alternately heated by the electric arc and cooled by one of the fluid streams such that the rock becomes thermally stressed.

17. The multimodal rock disintegration by thermal effect according to claim 1 characterized in that electric current in the electric arc is increased such that the electric arc expands, pushes against the rock, and concurrently pushes the disintegrated rock away from an area between the electric arc and the rock.

18. The multimodal rock disintegration by thermal effect according to claim 1 characterized in that electric current of the electric arc is increased by jumps so as to generate a pressure shockwave, which disintegrates the rock mechanically and pushes the rock away from an area where the rock is being disintegrated.

19. The multimodal rock disintegration by thermal effect according to claim 18 characterized in that one of the fluid streams enters between the rock and the electric arc and enhances the pressure shockwave on the rock being disintegrated.

20. A system for carrying out multimodal rock disintegration by thermal effect, the system comprising an electric arc generator characterized in that the electric arc generator comprises:

- a module configured to shape the electric arc via a vortex fluid stream;
- a system of tangentially oriented nozzles configured to form the vortex fluid stream;
- electrodes arranged so that one electrode is situated near an axis of another electrode;
- a module configured to guide and raise the disintegrated rock, the module containing a delimitation channel with a raising slot; the channel being configured to remove a mixture consisting of evaporated media and the disintegrated rock from an area of rock disintegration;
- control modules configured to regulate and modulate modes of fluid streams; and
- reflecting surfaces configured to guide heat flow into the area of rock disintegration.

21. The system for carrying out rock disintegration by thermal effect according to claim 20 characterized in that the module for shaping the electric arc comprises a magnetic field generator.

22. The system for carrying out rock disintegration by thermal effect according to claim 20 characterized in that the system further comprises control modules for regulation and modulation of modes of a magnetic force module.

23. The system for carrying out rock disintegration by thermal effect according to claim 20 characterized in that the reflecting surfaces for guiding the heat flow are arranged such that the heat flow is reflected and directed at the rock being disintegrated.

24. The system for carrying out rock disintegration by thermal effect according to claim 20 characterized in that the reflecting surfaces are part of one of the electrodes.

25. The system for carrying out rock disintegration by thermal effect according to claim 20 characterized in that the control modules for regulation and modulation of modes include at least one of reflective, logic and coordinating, and scanning and control elements.

* * * * *